United States Patent [19]

Rain

[11] 4,121,604

[45] Oct. 24, 1978

[54] RIGID FRAME STRUCTURE WITH TENSIONED MEMBRANE CLADDING

[75] Inventor: Lloyd Howard Rain, Lexington, Ky.

[73] Assignee: Irvin Industries Inc., Stamford, Conn.

[21] Appl. No.: 807,503

[22] Filed: Jun. 17, 1977

[51] Int. Cl.[2] ..... A45F 1/16

[52] U.S. Cl. ..... 135/4 R; 52/63; 135/15 CF; 135/DIG. 1

[58] Field of Search ..... 52/63, 86; 135/DIG. 1, 135/DIG. 8, 4 R, 15 CF; 4/172.12, 172.14; 296/104, 105, 136

[56] References Cited

U.S. PATENT DOCUMENTS

| | | | |
|---|---|---|---|
| 2,225,972 | 12/1940 | Brogren | 135/4 R |
| 2,497,596 | 2/1950 | Frieder et al. | 135/15 CF |
| 2,964,759 | 12/1960 | Riggs | 4/172.12 |
| 3,024,796 | 3/1962 | Bird | 135/15 CF |
| 3,150,670 | 9/1964 | Bird et al. | 135/15 CF X |
| 3,683,427 | 8/1972 | Burkholz et al. | 4/172.12 |

FOREIGN PATENT DOCUMENTS

| | | | |
|---|---|---|---|
| 623,900 | 5/1949 | United Kingdom | 135/DIG. 1 |
| 1,103,575 | 2/1968 | United Kingdom | 135/15 CF |

*Primary Examiner*—Price C. Faw, Jr.
*Assistant Examiner*—Conrad L. Berman
*Attorney, Agent, or Firm*—McAulay, Fields, Fisher & Goldstein

[57] ABSTRACT

A plurality of modular dual arch arrangements are aligned to provide the frame for a shelter. Each dual arch module constitutes first and second arches having their bases spaced from one another and leaning towards one another so that their crests rest against one another. The two arches are hinged to one another at their crests by a hinge. A fabric membrane is positioned over the arches and held in tension through various turnbuckles which attach the membrane to the bases which support the arches. A plurality of longitudinal fabric support bands are stretched longitudinally across the plurality of arches and held in tension to provide further support for the membrane.

13 Claims, 7 Drawing Figures

RIGID FRAME STRUCTURE WITH TENSIONED MEMBRANE CLADDING

BACKGROUND OF THE INVENTION

This invention relates in general to those structures in which a skeleton frame supports a fabric canopy to provide a shelter and more particularly to the structures of this type in which the skeleton frame is modular so that it can readily be erected and taken down and so that it can be easily transported in a disassembled state.

The purpose of all of these structures is to provide a readily transportable, relatively inexpensive structure which can be erected at a site quickly, at minimum cost and without requiring extensive or expensive construction equipment.

The purpose of this invention is to provide an improved structure which meets all of these objectives in an enhanced fashion.

More particularly, it is a purpose of this invention to provide such a structure in which there is an enhanced trade off of cost, transportability and ease of erection.

These structures, which are tent type structures, generally require guy-wires and support mechanisms that are anchored away from the area covered by the tent-like structure in order to provide stability for the structure. Wind loading and the modular nature of the structure create stability problems. For reasons of cost, ease of construction, and ease of disassembling, it is desirable that the modular portions not be too elaborately interconnected. As a consequence, there is a tendency for the structure to be somewhat unstable and to at least require extensive auxiliary support members such as posts and rails and support wires. These auxiliary structures are either outboard of the area covered by the shelter and thus require a more extensive ground plot than is sheltered, or inboard of the structure thus limiting use of the interior space.

Accordingly, it is another purpose of this invention to provide a structure which meets the above objectives and which also permits substantially covering an allocated ground plot without requiring substantial outboard or inboard supports.

The use of arches and fabric is one common way of meeting these objectives.

A number of patents to Karl S. Huddle illustrate the use of arches and fabric including U.S. Pat. No. 3,215,153 issued Nov. 2, 1965; U.S. Pat. No. 3,811,454 issued May 21, 1974; and U.S. Pat. No. 3,899,854 issued Aug. 19, 1975.

The U.S. Pat. No. 3,811,454 illustrates the use of arches which are pivotally connected to a base as a labor saving feature. In this design the fabric is used to support or hold the arches in place.

The U.S. Pat. No. 3,899,854 illustrates a relevant design which incorporates various transverse compression members and interconnections that contribute to the cost of erection and disassembly.

The arch support structure shown in the Spray U.S. Pat. No. 3,892,094 issued June 1, 1975 is typical of a group of structures in which there is appreciable interconnection between arched rods to provide structual stability but which interconnections provide a substantial cost of construction and disassembly.

A single dual arch arrangement is illustrated in the Sperling U.S. Pat. No. 3,365,846 issued Jan. 30, 1968. Although Sperling suggests the use of a single dual arch arrangement either for the roof of a house or for the structure of a tent, Sperling does not obtain the large scale shelter which it is an object of this invention to provide.

For relatively small type structures to cover a relatively small area, the advantages of a tent type of arrangement is usually quite clear cut. But, when it is desired to provide a large structure, such as in a pavilion at a fair or one in which a sporting event can be performed while accommodating numerous spectators, the cost advantages of a frame supporting a flexible fabric skin may be outweighed by the costs of construction and the instability of the structure.

Accordingly, it is an important purpose of this invention to provide an improved flexible fabric shelter which can be used to cover a relatively large field and which can be built with enough height to comfortably accommodate large numbers of people by providing adequate air space as well as space to accommodate lighting, banners and the like.

It is a further important purpose of this invention to provide such a shelter which is also very safe and more particularly a shelter in which the safety of the shelter does not depend on the structual integrity of the fabric or the skin covering.

BRIEF DESCRIPTION OF THE INVENTION

In brief, one embodiment of this invention employs as the basic frame a plurality of pairs of arches. Each arch pair includes first and second arches which have their bases spaced from one another and which tilt toward one another so that the crests of the two arches abut. The two arches in each pair lean against and support one another. The two arches are hinged to one another at the crest as an aid in erecting and disassembling the structure. A plurality of these arch pairs are aligned and spaced from one another so that they define an envelope something like a half tunnel. The width of the envelope, and thus of the structure, is substantially the span between the outer ends of each arch. The length of the structure is dependent upon the number of arched pairs provided and their spacing from one another. A fabric membrane is connected to the base on which the arches stand and is held in tension over the arches. The membrane is not tied to the arches. A plurality of flexible fabric bands are strung longitudinally across the arches to provide further support for the membrane, particularly under wind and snow loading. One such support band is connected along the crest of each arched pair and additional bands are connected on either side of the crest band. The fabric bands are connected to the end arches but are not connected to the membrane.

DESCRIPTION OF THE PREFERRED EMBODIMENTS

Figure 1:
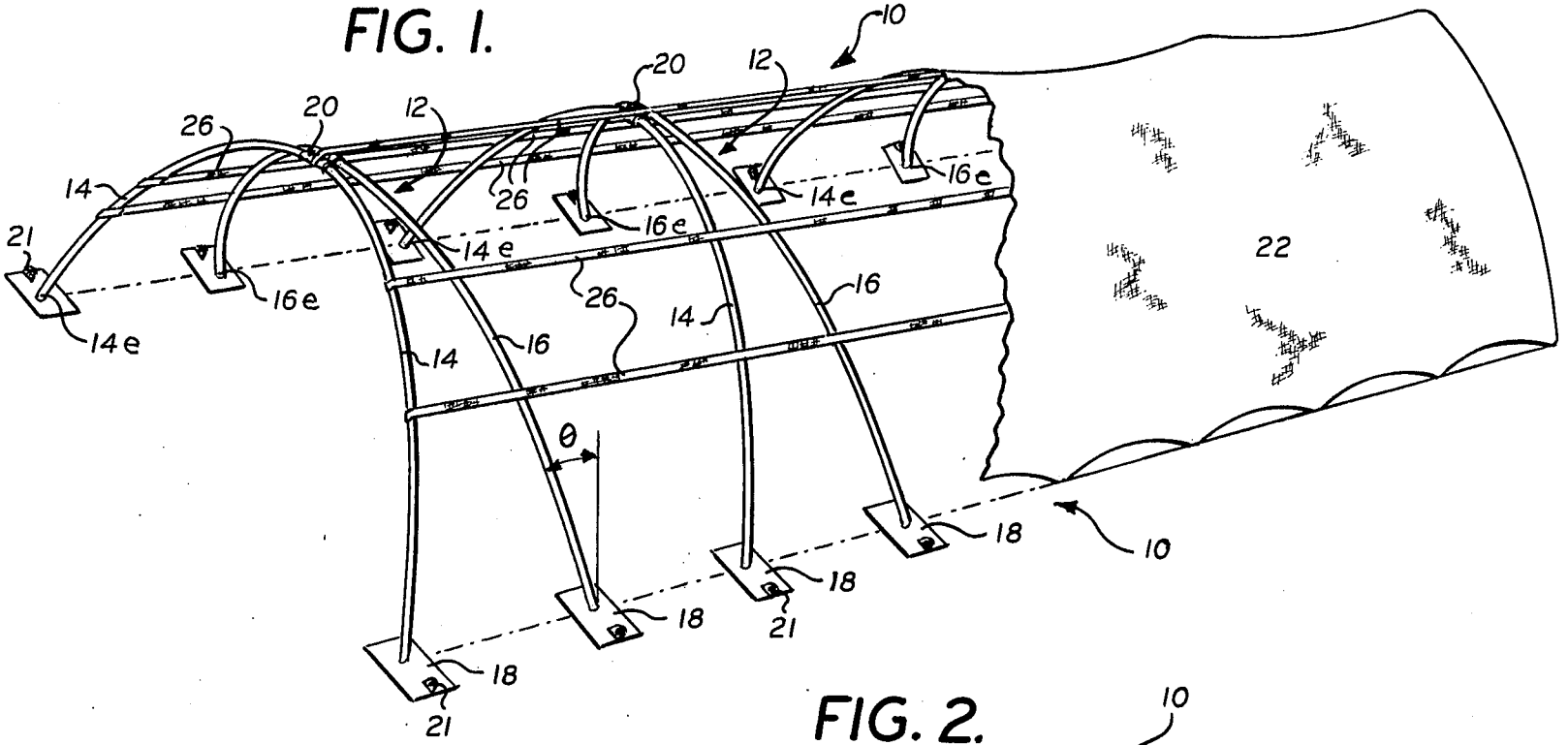
FIG. 1 is a perspective view of an embodiment of this invention in which a portion of the membrane is cut away in oder to show the arches which constitute the frame that is underneath and that supports the membrane.
Figure 2:
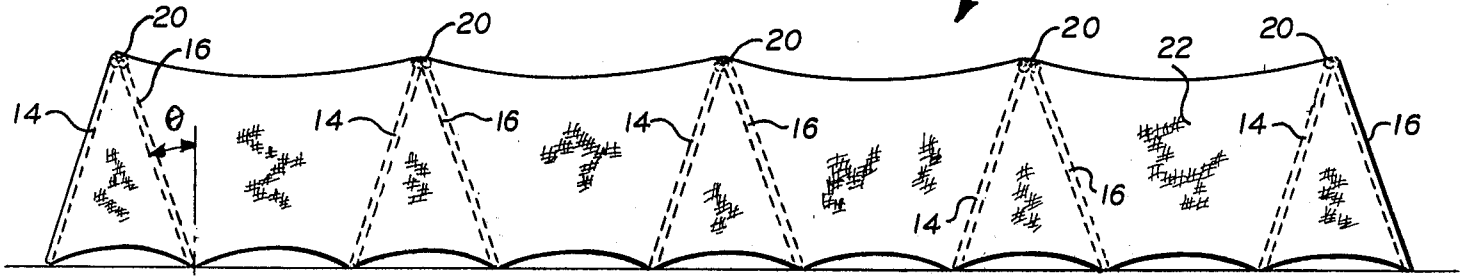
FIG. 2 is a side elevational view of the FIG. 1 embodiment.
Figure 3:
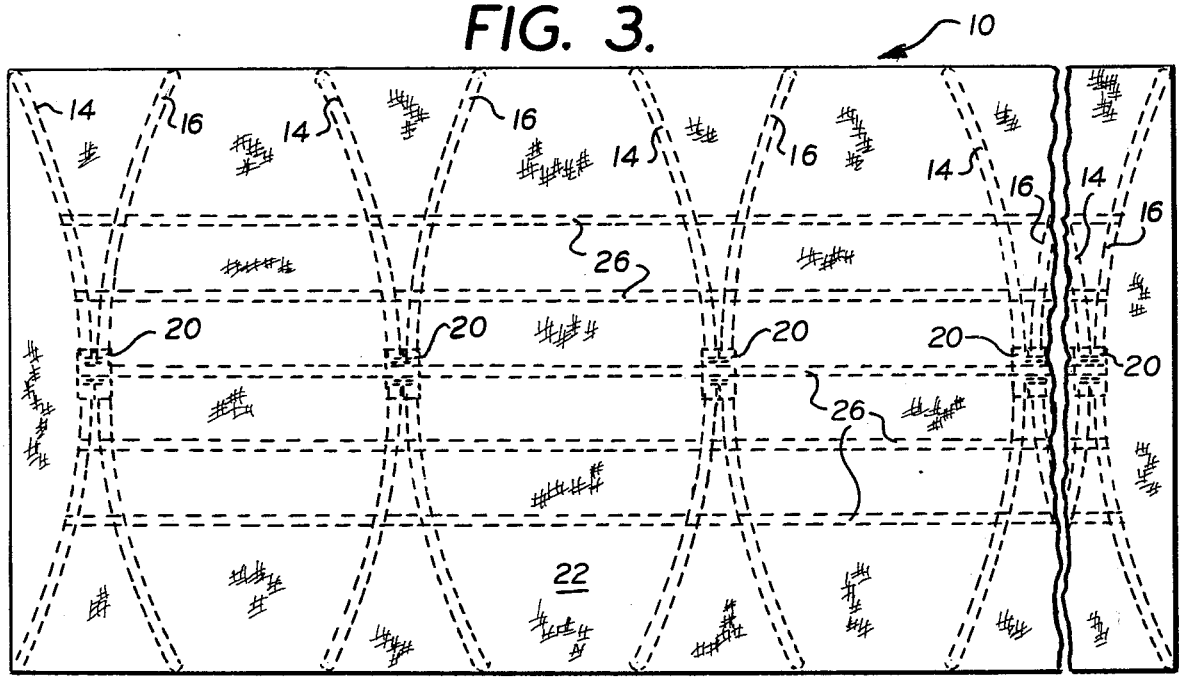
FIG. 3 is a top or plan view of the FIG. 1 embodiment.

With reference to the FIGS., all of which relate to the same embodiment, the shelter structure 10 is a frame composed of a plurality of arched pairs 12 over which a membrane canopy 22 is held in tension. Each arch pair 12 contains first and second arches 14 and 16. The ends 14*e* and 16*e* of each arch are connected to and supported by a foot plate 18. Within each arch pair 12, the ends 14*e* of the first arch 14 are spaced from the ends 16*e* of the second arch 16. The two arches 14, 16 are tilted toward each other away from the vertical by an angle and the crests of the arches 14, 16 are hinged to each other by a hinge 20.

The canopy 22 is a flexible collapsible membrane preferably of fabric. It is tensioned over the arch pairs 12. This fabric canopy 22 is connected to the foot plates 18 outboard of the arch ends 14*e*, 16*e*. A standard hold down coupling 21 such as a buckle on an inverted U structure is welded to the foot plate 18 and serves to tie down the canopy 22. The turnbuckle is employed to both tie down the fabric canopy 22 and to create tension across the canopy. In this fashion, the canopy is maintained under tension and thus tends to hold its position and shape.

Longitudinal fabric bands 26 made of Nylon web are strung over the arches 14, 16 and under the fabric canopy 22. These bands of webbing 26 provide additional support for the fabric canopy 22 and prevent substantial sagging of the canopy 22 especially under heavy wind or snow loads. They also provide support for the membrane 22 during erection. In the embodiment shown, one of these support bands 26 is connected across the crests of each arch pair 12 and two additional support bands 26 are employed on each side of the crest for a total of five support bands 26.

The fabric canopy 22 is connected solely at the foot plates 18 and thus is free to contract or expand relative to the arches 14, 16 at a different rate than do the arches. Where the fabric is Nylon, which will often be preferred, the coefficient of thermal expansion is negative. By contrast, the coefficient of thermal expansion of the preferably aluminum tubes which constitute the arches 14, 16 is positive. Thus, it is important that the canopy 22 be able to shift its position along the surface of the arches 14, 16 as temperature changes. Accordingly, it is important that the canopy 22 not be tied to the arches 14, 16 along the length of those arches.

The arches 14, 16 are made of aluminum tubular material, preferably round in cross section. The ends of these arches are welded along a circumferential bead to the foot plates 18. Each foot plate 18 is bolted by bolts 28 to a poured concrete footing 24.

In one embodiment of this invention as illustrated in the FIGS., the span across the ends of an arch 14 or 16 is eighty feet, the height of the crest of the arch is thirty feet and the spacing between the ends 14*e* and 16*e* of the two arches in each arch pair 12 is 30 feet. In that embodiment, the spacing between the ends 16*e* of one arch pair and the ends 14*e* of the adjacent arch pair is also thirty feet. Thus the bay width of that embodiment is a uniform 30 feet although there is no reason why it has to be uniform. Five arch pairs 12 are employed to provide nine bays for a total length of 270 feet. The arch is a curve with a uniform radius and thus is an arc of a circle. The angle theta ($\theta$) between the plane of the arch 12 or 14 and a vertical plane is 24°.

Figure 4:
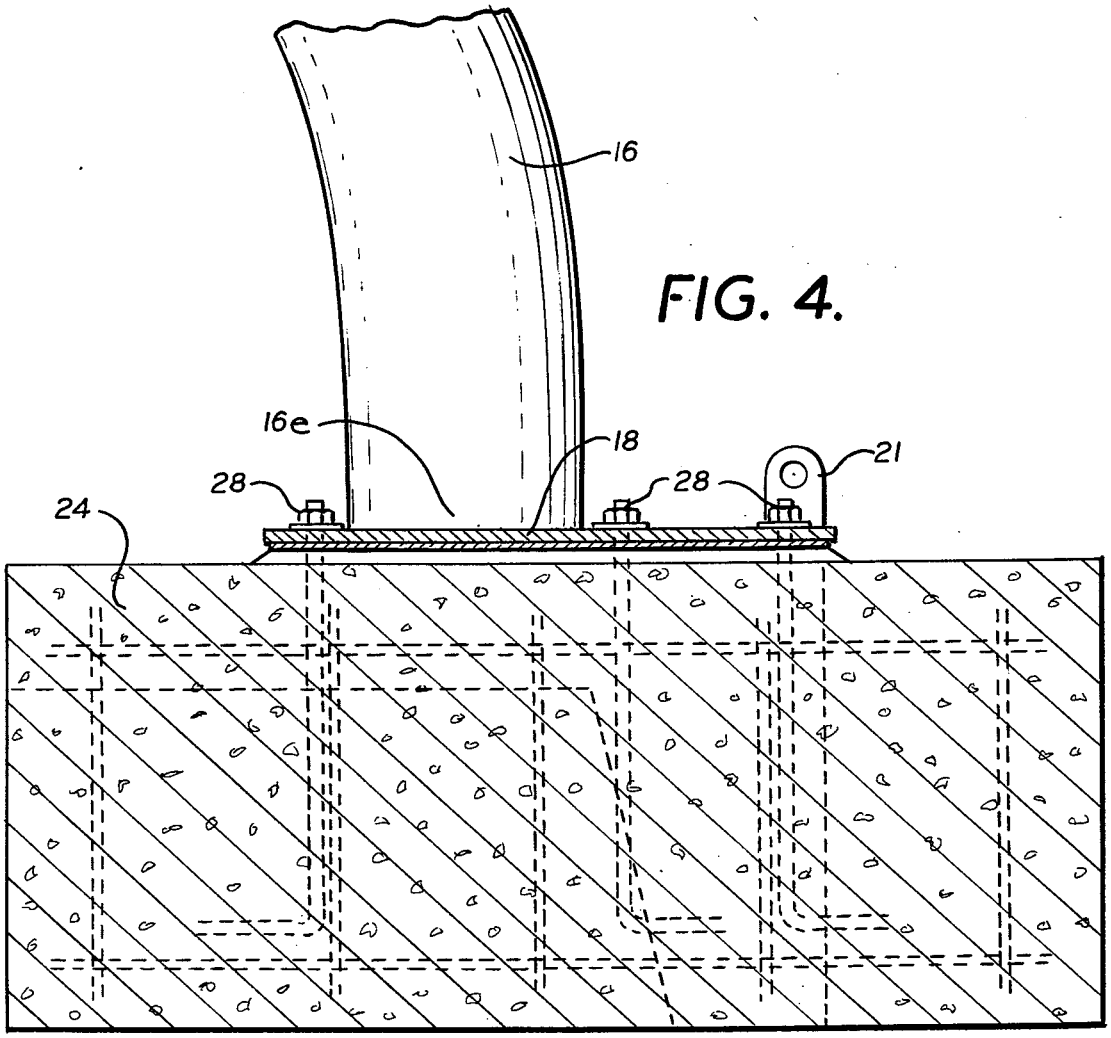
FIG. 4 is a cross-sectional view showing certain details of the foot plate that supports and positions each arch and to which the membrane is tied.

FIG. 4 is a section through the foot plate 18 that is taken transverse to the main longitudinal axis of the structure 10 and further is taken immediately adjacent to the end 16*e* of the particular arch illustrated so that the arch 16 is shown in relief. The plate 18 illustrated is two by three feet in dimension. The arch 16 is offset from the center of the plate 18 so that the plate 18 extends outboard of the structure by a foot more than it extends inboard. The foot plate 18 is welded to the arch 16 at an off site location. The foot plate 18 is then bolted by bolts 28 to the concrete footing 24 during the on site erection.

Figure 5:
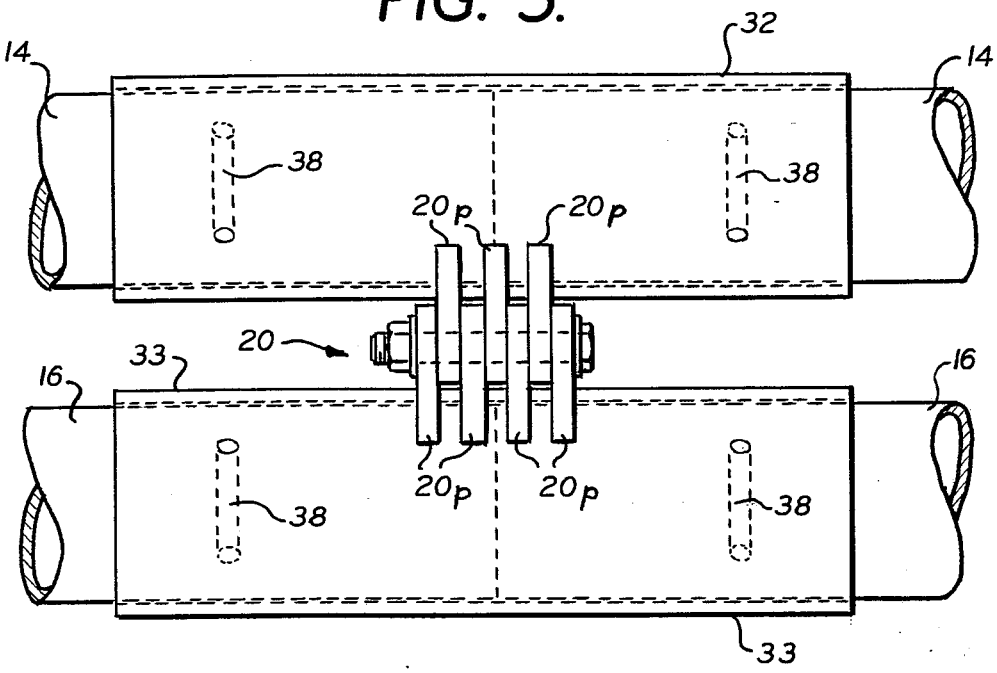
FIG. 5 is a perspective view of the crest of one of the arch pairs of FIG. 1 showing certain details of the multiplate hinge used to hold the two arches of a pair together.

As shown in FIG. 5, the hinge 20 is composed of seven interleaved plates 20*p*. Four of these plates 20*p* are welded to a tubular collar 33 around the arch 16 and three plates 20*p* are welded to a tubular collar 32 around the crest of the arch 14. These plates 20*p* are mounted for rotational movement around a hinge pin 36. In fabricating the hinge 20 it has been found important to stack the seven plates 20*p* on the hinge pin 36 before welding the plates to the collars 32, 33. Then with the plates held against one another so that they rotate relative to one another along the surfaces of adjacent plates, without racking, the various plates 20*p* are welded to the respective collars 33, 34 to form the hinge 20. The hinge 20 is then mounted onto the arches 14, 16 to thereby provide an arch pair 12.

In assembly on site, each arch 14, 16 is composed of at least two equal arch segments. As may best be understood by reference to FIG. 5, during on site assembly, the two arch segments (14*a*, 14*b* for example) are fed into opposite ends of the collar 32. The collar 32 and arch segments are then pinned together by pins 38 inserted through openings in the collar 32 and openings in the underlying arch segments 14*a* and 14*b*.

Although the arches 14 and 16 are shown as being composed of two segments which are joined together at the hinge 20 by collars 32 or 33, it should be understood that the arches 14 and 16 can be composed of a number of segments. Indeed, if the segments are sufficiently short, each segment could be a straight segment and the connections between segments arranged so as to provide an overall arch composed of a plurality of straight segments.

The canopy 22 is preferably a fabric but more generically it is a membrane. It is held in tension. But because it is collapsible and flexible it cannot sustain compression. More importantly, the membrane 22 and frame 12 relation is such that the membrane 22 functions solely as cladding. Cladding is the term used in the structural arts to refer to a protective covering that does not contribute to structural integrity.

Figure 6:
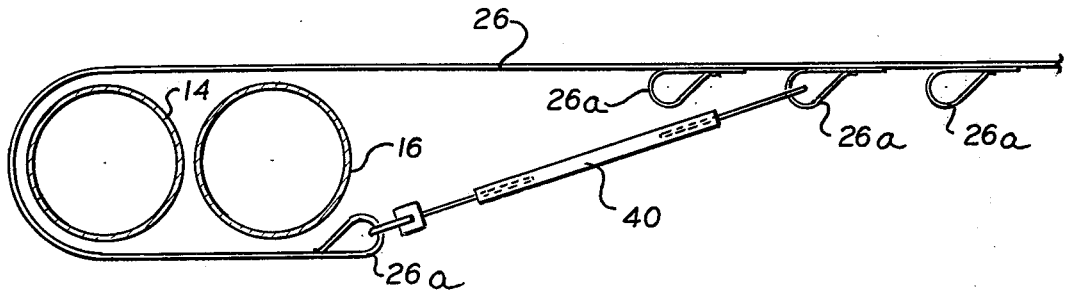
FIG. 6 is a detail view showing the manner in which the longitudinal support bands are held in tension.
Figure 7:
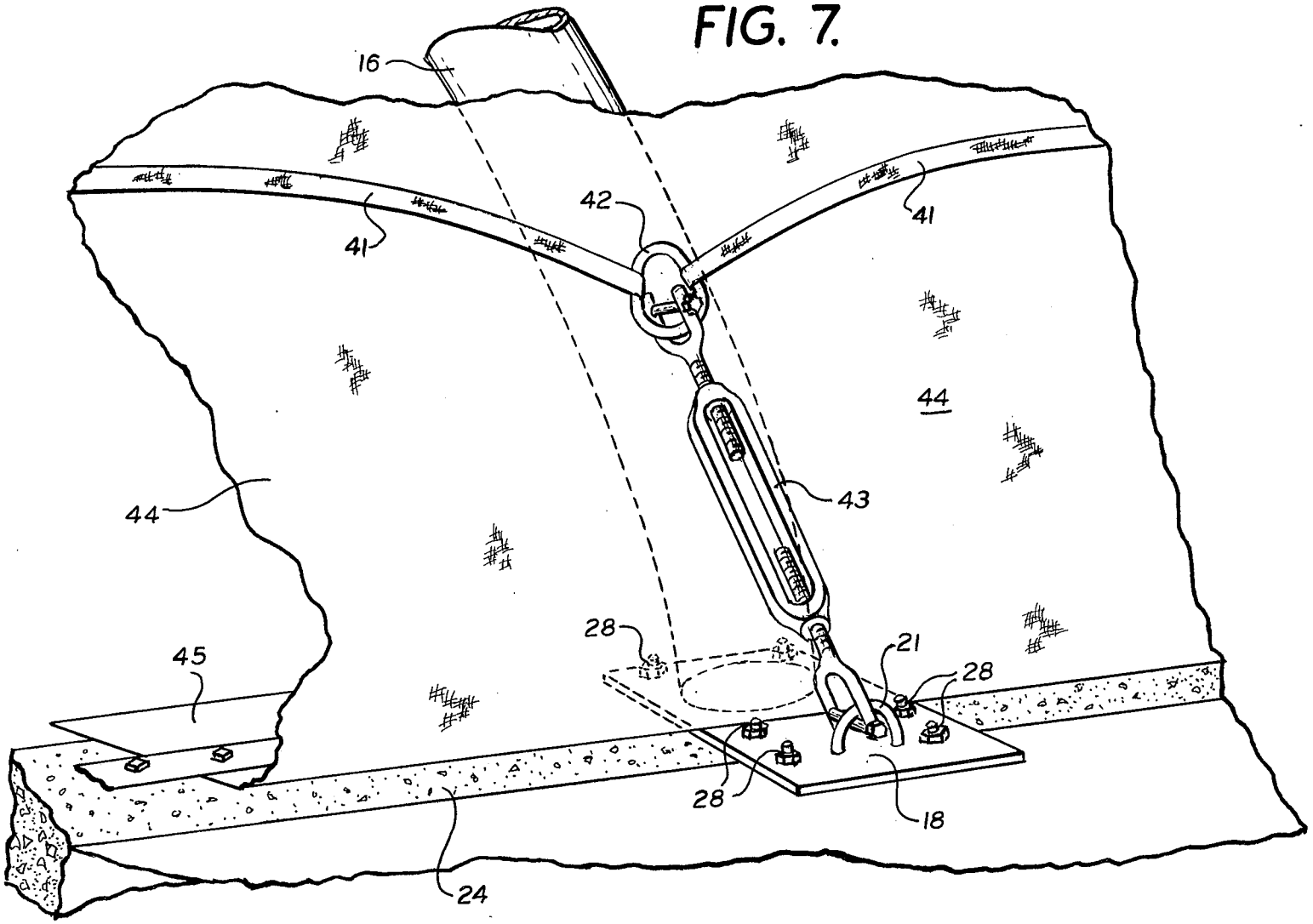
FIG. 7 is a detail view illustrating the mechanism used to hold down the sides of the fabric covering and to maintain the fabric in tension.

This structure can readily be erected and disassembled in the field. The arch portions are fabricated off site and are welded to the foot plate 18 off site. The hinge 20 is also fabricated off site including the welding of the plates 20*p* to the collars 32, 33. However, the hinge pin 36 is removable to facilitate erection and disassembly on site. On site, the free ends of the two halves of each of the two arches 14 and 16 are fed into the respective collars 32 and 33 and pinned in place by use of the collar pins 38. The hinge plates 20*p* are pinned together by use of the hinge pin 36 and the arch pair 12 is ready to be erected. It is then lifted into position and the foot plates 18 are bolted to the concrete footings 24. When the plurality of arch pairs 12 are all thus erected, each support band 26 is strung across the set of arch pairs and is wrapped around the end arches (arch 14 of the first arch pair and arch 16 of the last arch pair). As illustrated in FIG. 6, each band 26 is connected back unto itself by means of a jaw-jaw turnbuckle 40 coupled between band loops 26*a* so that these bands 26 can be drawn tight and held in tension. FIG. 6 illustrates the control band 26, but the rest of the bands are similarly coupled. The fabric membrane 22 is then drawn over the set of arches and the sides of this membrane 22 are tied down to the hold down elements 21 and thus held in tension. More specifically, as shown in greater detail in FIG. 7, there are web strips 41 sewn along the edge of the membrane 22. Ends of each web 41 are sewn around metal rings 42. Each ring 42 is coupled to a hold-down bracket 21 by means of a turnbuckle 43. The turnbuckle 43 is tightened to pull down the rings 42 and thus pull down the fabric 22 and thereby hold the fabric 22 in tension. The web strips 41 are reinforcing strips that form an approximately catenary shape when the membrane 22 is held in tension. Side infill panels 44 can be placed below the catenary line to close the shelter off to the ground. The infill panels 44 are turned under and held down by a clamp strip 45. Only one pull-down arrangement 42, 43, 21 is shown in FIG. 7 but there are a series of similar arrangements deployed along each side of the shelter 10.

The support bands 26 are of assistance in drawing the canopy 22 over the arches because the bands support the collapsible canopy and prevent excessive sagging between arches.

Although one embodiment of this invention has been described in some detail, it would be obvious to make certain variations in the embodiment described without departing from the scope of this invention.

For example, the support bands 26 although preferrably fabric and in particular neeting bands, could be of some other form such as flexible cable. The tubular structural sections out of which the arches 14 and 16 are made are preferrably a circular pipe. However, these sections could be square or even rectangular in cross section. The longitudinal crest line defined by the crests of the arch pairs 12 is shown as a straight line. However, the crest line could be curvilinear.

What is claimed is:

1. A shelter comprising:

a flexible membrane and a frame underneath said membrane supporting said membrane, said membrane cladding said frame.

said frame including a plurality of arched pairs, each of said pairs having first and second arched hollow structural sections, each of said arched sections having first and second base ends and a crest intermediate said ends, in each of said arched pairs, said base ends of said first section being spaced from said base ends of said second section, said crest of said first section being adjacent to and hinged to said crest of said second section, said crests of the first and second sections being substantially closer to one another than are said base ends of said first and second sections, said plurality of arched pairs being aligned to form said frame having a convex outer envelope, said crests of each arched sections of all of said pairs being substantially aligned to define a longitudinal crest of said shelter, a plurality of longitudinal flexible support bands extending across said arched pairs substantially parallel to said longitudinal crest and deployed beneath said membrane to provide for said membrane, said support bands being connected solely to said arched pairs, said arched pairs and said longitudinal bands providing substantially the sole support for said membrane, a base, said base ends of said arched sections being supported on said base, coupling means connecting said membrane to said base and holding said membrane in tension over said arched sections, said coupling means providing the sole connection between said membrane and the structural elements of said shelter.

2. A shelter comprising:

a flexible membrane and a frame underneath said membrane and supporting said membrane, said membrane cladding said frame, said frame including a plurality of arched pairs, each of said pairs having first and second arched members, each of said arched members having first and second base ends and a crest intermediate said ends, in each of said arched pairs, said crests of said first and second members being in close proximity to one another and pivotally connected to one another, said base ends of said first member being spaced from the corresponding base ends of said second member, said first and second members being canted toward one another so that the plane of each arched member forms an angle with a vertical plane, said spacing and said angle being sufficiently great so that each arched pair has substantial structural stability because of the relationship between said arched members of said pair when said base ends are fixed, said plurality of arched pairs being arranged to form said frame having a convex outer envelope, said crests of each arched member of all of said pairs being arranged to define a longitudinal crest of said shelter, said plurality of arched pairs providing substantially the sole support for said membrane, compressive forces in said arched members being induced substantially solely by said membrane when under tension and loading.

3. The shelter of claim 2 further comprising: a hinge providing said pivotal connection between said crest of said first arched member and said crest of said second arched member in each of said arched pairs.

4. The shelter of claim 2 wherein each of said arched members of each of said arched pairs is comprised of a hollow structural section.

5. The shelter of claim 2 wherein said longitudinal crest is substantially a straight line.

6. The shelter of claim 2 further comprising:

a base, said arched members being supported on said base, coupling means connecting said membrane to said base, said membrane being connected solely to said base and held in tension over said arched members by said coupling means.

7. The shelter of claim 2 further comprising:

a plurality of flexible longitudinal bands deployed underneath said membrane to provide additional support for said membrane.

8. The shelter of claim 7 wherein said longitudinal flexible bands are fabric webbing.

9. The shelter of claim 7 further comprising:

a base, said arched members being supported on said base, coupling means connecting said membrane to said base, said membrane being connected solely to said base and held in tension over said arched members by said coupling means.

10. The shelter of claim 7 further comprising: a hinge providing said pivotal connection between said crest of said first arched member and said crest of said second arched member in each of said arched pairs.

11. The shelter of claim 10 further comprising:

a base, said arched members being supported on said base, coupling means connecting said membrane to said base, said membrane being connected solely to said base and held in tension over said arched members by said coupling means.

12. The shelter of claim 10 wherein each of said arched members of each of said arched pairs is comprised of a hollow structural section.

13. The shelter of claim 12 wherein each of said hollow structural sections is a tubular member having a circular cross section.

* * * * *